US009497825B2

(12) United States Patent
Chernashkin

(10) Patent No.: US 9,497,825 B2
(45) Date of Patent: Nov. 15, 2016

(54) ELECTRO-LUMINESCENT WIRE

(75) Inventor: Gennady Chernashkin, Moscow (RU)

(73) Assignee: ADV TECHNOMIG SA, Paradiso (CH)

( * ) Notice: Subject to any disclaimer, the term of this patent is extended or adjusted under 35 U.S.C. 154(b) by 770 days.

(21) Appl. No.: 13/993,856

(22) PCT Filed: Dec. 29, 2010
(Under 37 CFR 1.47)

(86) PCT No.: PCT/IB2010/056108

§ 371 (c)(1),
(2), (4) Date: Feb. 11, 2014

(87) PCT Pub. No.: WO2012/090025

PCT Pub. Date: Jul. 5, 2012

(65) Prior Publication Data

US 2016/0249433 A1 Aug. 25, 2016

(51) Int. Cl.

| | |
|---|---|
| ***H01J 1/62*** | (2006.01) |
| ***H05B 33/26*** | (2006.01) |
| ***H05B 33/14*** | (2006.01) |
| ***H05B 33/10*** | (2006.01) |
| ***H05B 33/04*** | (2006.01) |

(52) U.S. Cl.
CPC ..... *H05B 33/26* (2013.01); *H05B 33/04* (2013.01); *H05B 33/10* (2013.01); *H05B 33/145* (2013.01)

(58) Field of Classification Search
CPC ..... H01B 33/26; H01B 33/10; H01B 33/04; H01B 33/145
See application file for complete search history.

(56) References Cited

U.S. PATENT DOCUMENTS

| | | | |
|---|---|---|---|
| 3,052,812 | A | 9/1962 | Dow |
| 2008/0036375 | A1 | 2/2008 | Zheng |

FOREIGN PATENT DOCUMENTS

| | | |
|---|---|---|
| WO | WO/2005/096075 | 10/2005 |
| WO | WO 2007/004223 | 1/2007 |

OTHER PUBLICATIONS

Akashi et al. "Polymer Gel Light-Modulation Materials Imitating Pigment Cells" Advanced Materials; 14; No. 24; Dec. 17, 2002; pp. 1808-1811.

International Search Report from International Application No. PCT/IB2010/056108 mailed Sep. 19, 2011.

*Primary Examiner* — Joseph L Williams
(74) *Attorney, Agent, or Firm* — Dorsey & Whitney LLP

(57) ABSTRACT

The invention describes an electro-luminescent wire comprising at least two conductors, having substantially longitudinal extensions, parallel to each other and insulated electrically, the conductors being supplied electrically to generate an electromagnetic field therebetween. A luminescent gelatinous substance covers at least one of the conductors and a transparent plastic film encloses the luminescent gelatinous substance and the conductors; the luminescent gelatinous substance emits light in presence of an electromagnetic field generated by the conductors.

14 Claims, 5 Drawing Sheets

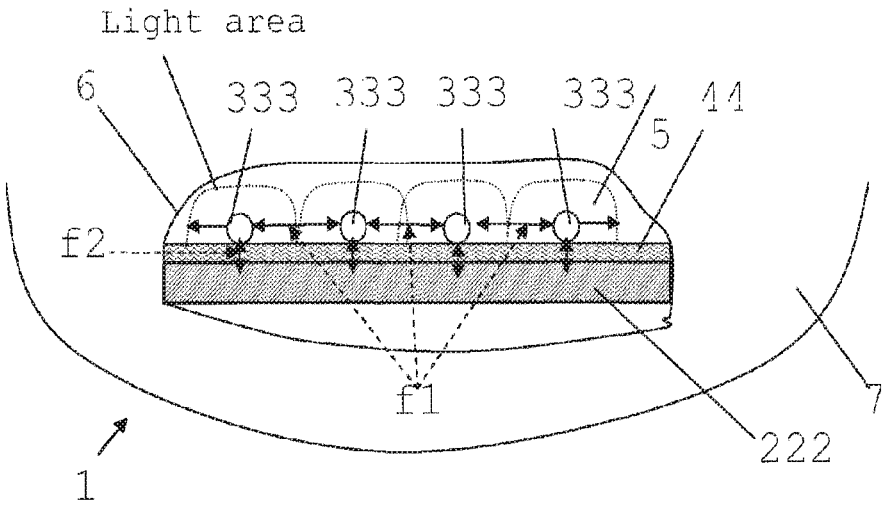
Fig. 4
Fig. 5a
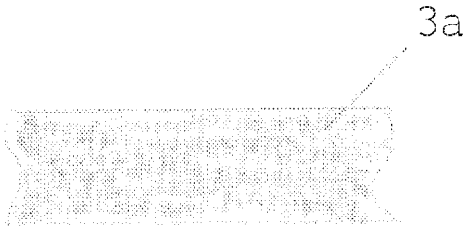
Fig. 5b
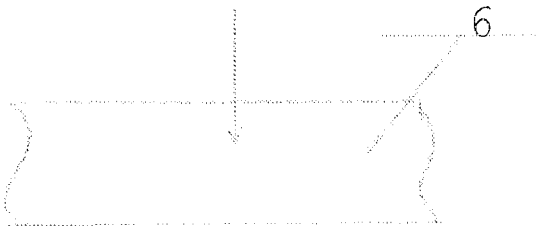
Fig. 5c
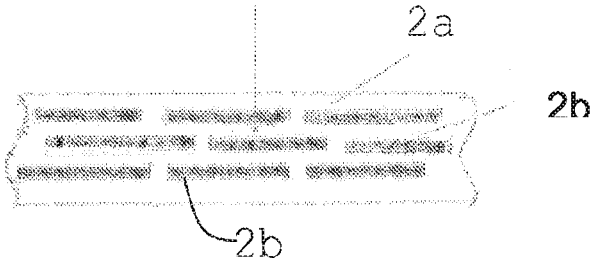
Fig. 5
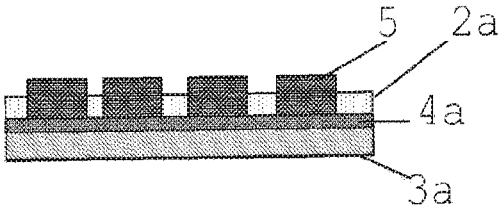

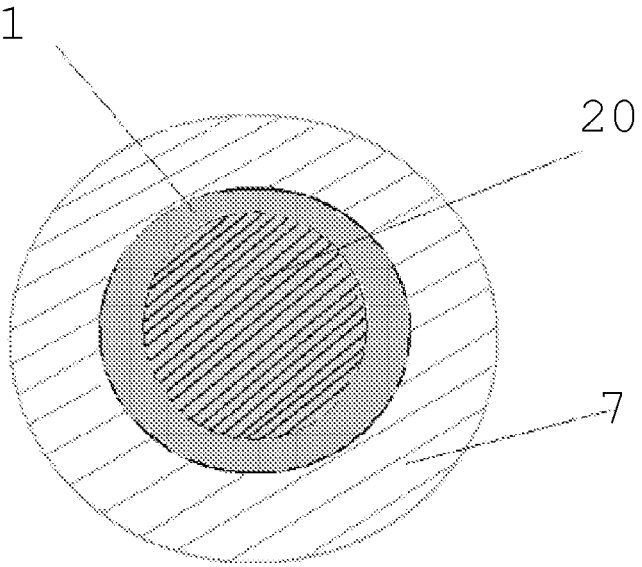
Fig. 7a
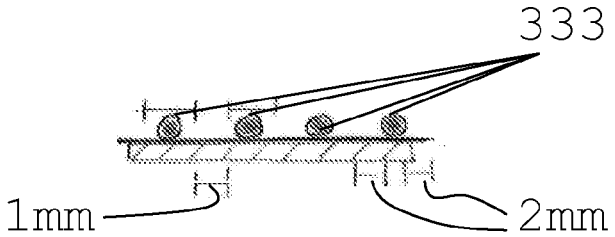
Fig. 4a
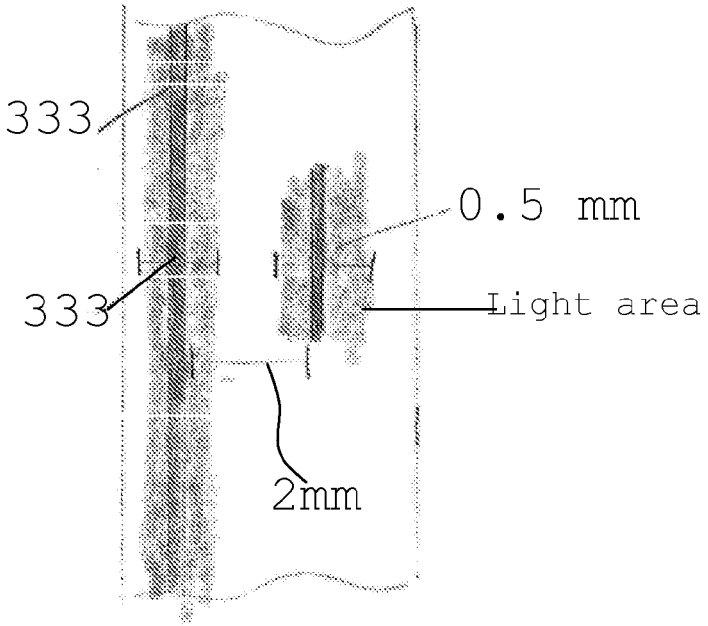

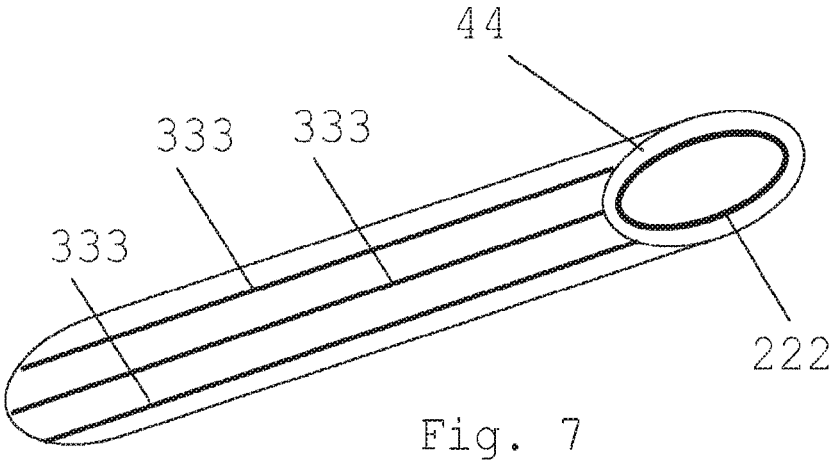
Fig. 7
Fig. 6
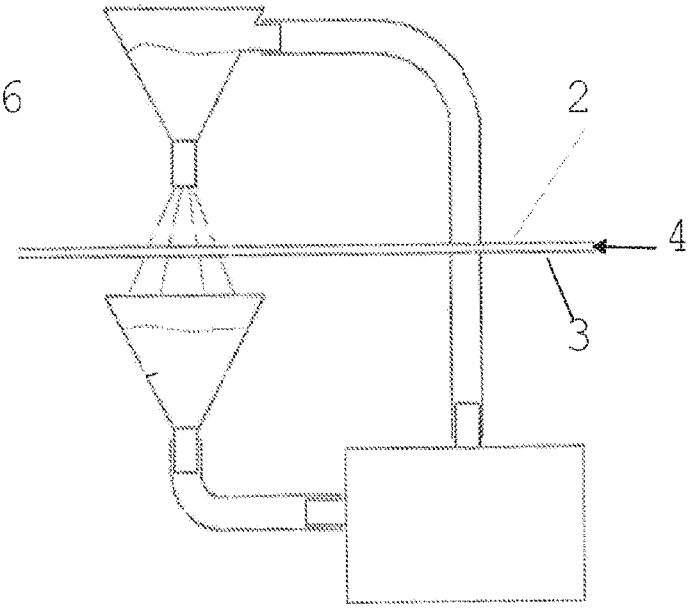

ELECTRO-LUMINESCENT WIRE

FIELD OF APPLICATION

The present invention refers to an electro-luminescent wire comprising at least two conductors having a substantially longitudinal extension, parallel to each other and insulated as well as a luminescent material; the conductors are supplied electrically to generate an electromagnetic field in whose presence the luminescent material emits light. The invention also refers to a method for producing an electro-luminescent wire of the aforementioned type.

PRIOR ART

As known, an electro-luminescent wire comprises a first and a second conductor and a solid luminescent layer between the two conductors. For example the conductors are wires and the solid luminescent layer is a coating made of luminescent material, solidified externally with respect to the wire. In particular, the first and the second conductor are supplied electrically, with reverse polarities of an alternating current AC, to generate an electromagnetic field therebetween; such field excites the solid luminescent layer, allowing the wire to emit light. Obviously, an insulating layer is provided therebetween to prevent the first and the second conductor from short-circuiting.

In particular, the solid luminescent layer of the known electro-luminescent wires is provided through a process for drying a luminescent material-base mixture and a dielectric liquid; the mixture is subjected to a thermal heating process or it is exposed to UV (Ultra Violet) rays, which solidify it around the conductor generating the abovementioned solid luminescent layer. The end portions of the conductors project from the solid layer, to be connected to the respective polarities of an electrical power supplier in alternating current, and thus generate the electromagnetic field which allows the solid luminescent layer to emit light.

Such electro-luminescent wires reveal some structural drawbacks, which are observed in the light emission capacity thereof, and other drawbacks related to the method of production thereof.

In particular, during the solidification of the mixture around the conductors in the solid luminescent layer, the molecular structure of the dielectric liquid and of the luminescent material on which the mixture is based is subjected to some alterations which reduce the light emission capacity thereof. Actually, solidification causes some micro-cracks, i.e. microscopic cracks and discontinuity in the solid luminescent layer, which considerably reduce the light emission of the layer in presence of the electromagnetic field. Furthermore, the presence of micro-cracks makes the solid luminescent layer susceptible to structural yields which consist in the loss of granules of the luminescent material, with ensuing and further reduction of light emission. Lastly, the drying alters the colour of the mixture, generally making the solid luminescent layer darker than the initial mixture, and thus also altering the colour of the emitted light.

Regarding the production process, the drying step is rather complex and requires long operation times, especially for providing considerably long electro-luminescent wires, i.e. several meters long. In such case, it is necessary to submerge the conductor in a special container of the mixture and use special lamps for drying the mixture, along the entire length of the wire. However, using lamps covering the entire length of the wire, in order to quicken the drying process, is very expensive. Alternatively, it is possible to dry the mixture around a portion of the conductor at a time, i.e. by providing a first piece of electro-luminescent wire, and repeating this operation over the entire length of the conductors, substantially drying the mixture on the various pieces of the wire. In this case, the operating times are very long, given that it requires waiting for the mixture to dry on each piece of the wire, and hence the cost of production is high.

The problem on which the present invention is based is that of providing an electro-luminescent wire having improved structural properties, and i.e. capable of emitting a light of greater intensity with respect to the known electro-luminescent wires, not susceptible to structural alterations over time capable of reducing the light emission thereof, but also that of providing a relative production method capable of allowing considerably reducing the operational times and simplifying the production of the wire, especially a wire of considerable length, substantially overcoming all the drawbacks affecting the electro-luminescent wires and the relative method of production up to date.

SUMMARY OF THE INVENTION

The idea on which the present invention is based is that of replacing the solid luminescent layer of an electro-luminescent wire with a luminescent gelatinous substance having a greater light emission capacity in presence of an electromagnetic field, and associating the gelatinous substance to the conductors of the electro-luminescent wire through a transparent plastic film, thus attaining a considerable quickening of the wire production process, given that it no longer requires a drying step, and thus also avoiding alterations that such drying step would cause in the luminescent gelatinous substance.

According to such solution idea, the technical drawback is overcome by an electro-luminescent wire comprising at least two conductors having a substantially longitudinal extension, parallel to each other and insulated, said conductors being supplied electrically to generate an electromagnetic field therebetween, characterised in that it comprises a luminescent gelatinous substance which covers at least one of the two conductors and a transparent plastic film which encloses the luminescent gelatinous substance and the conductors, such luminescent gelatinous substance emitting light in presence of the electromagnetic field.

As clear from the description that follows, provided by way of example and with reference to some embodiments of the invention, which shall not be deemed restrictive with respect to the scope of protection thereof, the conductors, the luminescent gelatinous substance and the transparent plastic film can be structurally associated in several ways within the wire. For example, the conductors can be a plurality of parallel wire conductors, substantially coplanar, alternatingly connected to the reverse polarities of the power supplier, and submerged in the luminescent gelatinous substance; in such embodiments, the wires associated to a polarity can be insulated from the wires associated to the other polarity through an insulating coating, by applying on all the wires or only on alternate wires, i.e. to the wires associated to a given polarity.

Alternatively, the conductors can be two parallel plates, at least one of which is perforated and insulated electrically from the other by means of a film; or a first conductor can be formed by a plate and a second conductor can be formed by a plurality of conductive wires, positioned above the plate and insulated thereby, through an insulator film. In both cases, the luminescent gelatinous substance is at contact with at least one of the two conductors and the insulator film electrically insulates the two conductors; in particular, such films prevent the luminescent gelatinous substance from conducting current between the two conductors, causing a short circuit.

The wire with one plate or two plates can also be configured to obtain more complex forms of wires, for example an electro-luminescent tube. In such case, the plate or the plates are metal layers substantially flat, flexible and overlapped; the wire is enclosed on itself coupling the opposite large sides of the flat metal layers, and forming an electro-luminescent tube whose outer surface is covered by a luminescent gelatinous substance, for emitting light radially with respect to the tube. It is thus clear that the wire of the present invention can be structurally made according to various arrangements of the conductors and of the relative insulator, as well as of the luminescent gelatinous substance and the plastic film, thus leading to various wire configurations.

The applicant discovered surprising advantages in the electro-luminescent wire according to this invention which are mainly, but not exclusively, concentrated in an improved emission of light; actually, the gelatinous substance is not subjected to the alterations of the molecular structure instead observed in the processes for drying a luminescent mixture.

In particular, the luminescent gelatinous substance is provided through chemical dispersion of a luminescent material insoluble in a dielectric liquid, and it is in form of gel or emulsion, having a viscosity at the temperature of processing the wire, i.e. at ambient temperature, that guarantees adhesion thereof, at a predetermined degree, to the electrical conductors. The machining process is considerably simplified and quickened given that the gelatinous substance can be simply poured over the entire length of the conductors, for example sliding the conductors quickly under a gel supply head, and the transparent plastic film is applied, substantially wound, along the entire length of the wire, through only one and simple operation.

In the various embodiments of the invention, there is provided for the possibility of coating the electro-luminescent wire with protective plastic material, which is applied externally with respect to the transparent plastic film; such protective material can be applied through extrusion or moulding.

The applicant discovered that the greater luminosity can be attained by providing a luminescent gelatinous substance comprising luminescent material and a transparent insulating paint. Preferably the luminescent material comprises the following compounds: zinc sulphide (ZnS), copper (Cu), Manganese (Mn), Oxide hydroxide mixed with Aluminium [$Al(OH)_x(O)_y$]. Even more preferably with this percentage: ZnS>90%; $Al(OH)_x(O)_y$>3%; Cu ppm; Mn ppm. The electrical insulating paint is preferably enamel, and the percentage of paint in the gelatinous substance is of about 75% while the percentage of luminescent material is of about 25%. Naturally, the luminescent gelatinous substance is transparent.

The applicant also identified some dimensional characteristics and some ideal materials for providing the components of the electro-luminescent wire and in particular: the conductive wires are preferably made of silver or copper, preferably having thickness comprised between 0.180 mm and 0.200 mm and spaced therebetween by 0.020 mm-0.030 mm; the coating of the conductive wires is made of enamel and the luminescent gelatinous substance forms a layer around the conductive wires having thickness preferably comprised between 0.020 mm-0.025 mm; the transparent plastic film preferably has a thickness of 0.075 mm. Advantageously, this structure of the wire with conductive wires has an optimal light emission given that the layer of gelatinous substance around the wire is uniformly involved by the electromagnetic field and emits a light which uniformly lights a predetermined space around the wire, such space comprising the centre distance line/s between the wire and the wire/s adjacent thereto. Such dimensioning is also advantageous in terms of energy saving.

According to the base solution idea described above, the technical drawback on which the present invention is based is also overcome by a method for producing an electro-luminescent wire comprising the steps of: —arranging parallel and at a predetermined distance at least two conductors having a substantially longitudinal extension and insulated with respect to each other; —actuating a supply head of a luminescent gelatinous substance and sliding the conductors beneath the supply head, allowing a layer of luminescent gelatinous substance to stick to the conductors, —covering the conductors and the luminescent gelatinous substance with a transparent plastic film. The luminescent gelatinous substance is provided through chemical dispersion of a luminescent material in a transparent insulating paint, through a ultrasonic reactor, before being submerged in the supply head. A finishing step is provided for covering the transparent plastic film with a transparent plastic protective layer, for example extruded.

Further characteristics and advantages of the electro-luminescent wire and the embodiment thereof according to the present invention, shall be clear from the description that follows, provided by way of exemplifying and non-limiting example with reference to the attached drawings.

BRIEF DESCRIPTION OF THE DRAWINGS

FIG. 4 schematically represents an electro-luminescent wire according to another aspect of the present invention;

FIG. 4*a* schematically represents a detail of the electro-luminescent wire according to FIG. 4;

FIGS. 5-5*c* schematically represent an electro-luminescent wire according to another aspect of the present invention;

FIG. 6 schematically represents a machine for producing the electro-luminescent wire according to, the method of production of the present invention;

FIG. 7 schematically represents a luminescent tube according to the present invention;

FIG. 7*a* schematically represents a cross-section of the luminescent tube of FIG. 7;

DETAILED DESCRIPTION

Figure 3:
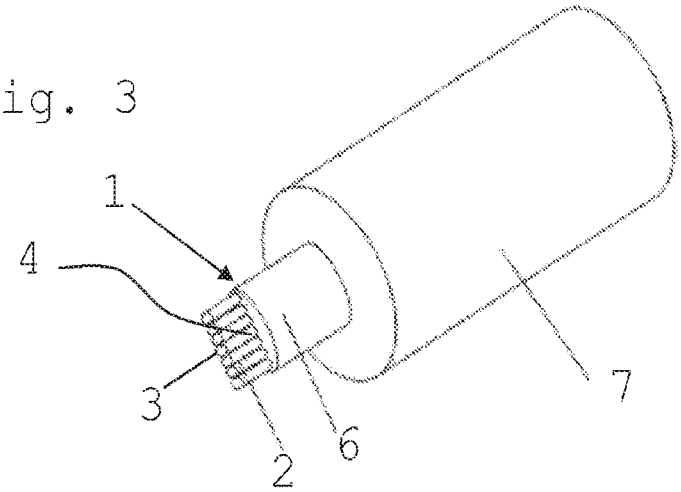
FIG. 3 schematically represents the electro-luminescent wire of FIG. 1 or 2, covered by a protection material, according to the present invention.
Figure 1:
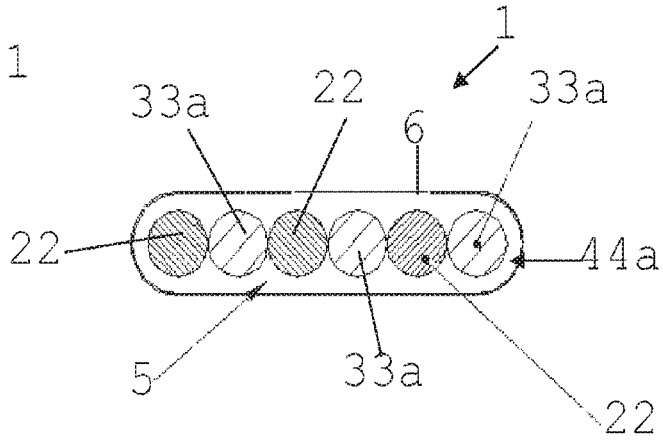
FIG. 1 schematically represents an electro-luminescent wire according to the present invention.
Figure 2:
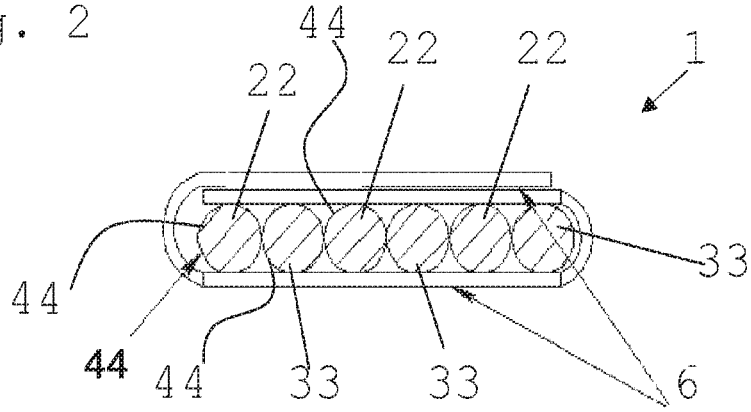
FIG. 2 schematically represents an electro-luminescent wire according to another aspect of the present invention.

With reference to FIG. 1 an electro-luminescent wire according to the present invention, comprising a transparent plastic film 6, a luminescent gelatinous substance 5 enclosed by the film 6, and conductors 22, 33*a* substantially submerged in the luminescent gelatinous substance 5 is schematically represented and indicated with 1. The conductors 22, 33*a* are drawn very close to each other but a predetermined interspace in which there is the luminescent gelatinous substance 5 is provided therebetween. The conductors 22, 33*a* are for example parallel conductor wires which can be power-supplied in alternating current; in particular, the conductor wires 33*a* are connectable to a first polarity of an electric power supply while the conductor wires 22 are electrically connectable to the reversed polarity. The wires 33*a* are covered by an insulator or sheath 44*a* to avoid a short-circuit with the wires 22, due to the presence of luminescent gelatinous substance which serves as a conductor. Advantageously, in order to reduce the width of the electro-luminescent wire, without however reducing the intensity of emitted light, the wires 22 connected to the same polarity are not covered by insulating material or sheath. FIG. 2 schematically represents a variant embodiment in which all the wires 22, 33 are covered by an insulating sheath 44, and a transparent plastic film 6 is substantially wound around the wires, holding the luminescent gelatinous substance 5 in an area that is involved by an electromagnetic field, given that the wires are power-supplied. Also in this case, the wires are drawn substantially at contact but a predetermined space, in which the gelatinous substance found, is provided therebetween.

According to the aforementioned embodiments, the conductive wires are preferably made of silver or copper, preferably having thickness comprised between 0.180 mm and 0.200 mm and spaced therebetween by 0.020 mm-0.030 mm; the coating of the conductive wires is made of enamel and the luminescent gelatinous substance forms a layer around the conductive wires having thickness preferably comprised between 0.020 mm-0.025 mm; the transparent plastic film preferably has a thickness of 0.075 mm.

FIG. 4 represents an electro-luminescent wire according to the present invention in which a first conductor, electrically connectable to a first polarity, is formed by a plate or substantially flat layer 222, and the second conductor is formed by a plurality of conductor wires 333, positioned parallel and with preset inter-space above an insulating layer 44 which is interposed between the wires 333 and the substantially flat layer 222; a layer of luminescent gelatinous substance 5 sticks to each conductor wire 333, preferably without touching the layer of gelatinous substance which sticks to the wires nearby. The wires and the flat layer are flexible; in particular the flat layer can be a metal sheet. The insulating layer 44 insulates the flat layer 222 from the wires 333, preventing the luminescent substance from conducting: current between the layer 222 and the wires 333. The transparent plastic film 6 is applied externally and holds the substance at contact with the wires. It is provided for that the flat electro-luminescent wire thus structured can be folded on itself, as schematically represented in FIG. 7, coupling the opposite large sides of the flat wire and providing an electro-luminescent tube, having the conductive wires arranged parallel to the axis of the tube and along the outer surface thereof; the gelatinous substance at contact with the wires 333 and the transparent protective film 6 is not indicated in FIG. 7, for the sake of simplicity and representation clarity. FIG. 7*a* is a cross-section of the electro-luminescent tube in which there is represented a support structure 20 for supporting a core of the electro-luminescent wire 1, tube-enclosed, and a protective layer 7 applied outside the tube, preferably through extrusion.

Preferably, according to this embodiment, the wires 333 are not coated by an insulating sheath and the function of insulation between the layer 222 and the wires 333 is provided only by the layer 44. Advantageously, in this case, the light intensity that can be emitted by the electro-luminescent wire is considerable, given that the absence of the sheath between the wires allows considerably nearing the wires and generating an electromagnetic field of considerable intensity therebetween.

Advantageously, the applicant observed that the configuration of the wires 333 and of the flat layer 222, substantially as represented in the cross-section of FIG. 4, with the connection of the wires 333 to a polarity and of the flat layer 222 to the reversed polarity, generates an electromagnetic field which is extended not only longitudinally between the wires 333, according to what is indicated solely by way of example by the arrows f1 of FIG. 4, but also transversely between the wires 333 and the flat layer 222, according to what is indicated also by way of example by the arrows f2 of the same figure, thus allowing a greater emission of light through the luminescent gelatinous substance.

The applicant also observed that—regarding the embodiments of FIG. 4—using conductor wires 333 having a 0.200 mm width and non-coated, light emission is extended for about 0.5 mm on both sides of each wire; in this case, the wires 333 can be spaced by 2 mm, as schematically provided in FIG. 4*a*. Advantageously, this arrangement allows providing a flat electro-luminescent wire having a width of 16 mm comprising 8 conductive wires 333, having an optimal light emission.

FIG. 5 schematically represents another embodiment of the invention in which two substantially flat layers 3*a* and 2*a* are separated by an insulator 4*a*; at least one of the two layers 2*a* comprises through holes, for example windows or openings 2*b*, which receive the luminescent gelatinous substance 5 which is preferably in relief, over the surface of the layer 2*a*. The transparent plastic film 6 encloses the flat layers 2*a*, 3*a* and the gelatinous substance 5. Also in this case, the electro-luminescent wire can be tube-closed, substantially as described with reference to FIG. 7; in particular, the layers 2*a* and 3*a* and the film 6, separately represented in FIGS. 5*a*-5*c*, are flexible.

According to the present invention, the luminescent gelatinous substance 5 is a suspension obtained through a chemical dispersion of a luminescent material, insoluble, in an electrical insulating paint, transparent and liquid. Preferably, the luminescent material is a luminescent powder comprising a high percentage of zinc sulphide. Added to the latter compound is a metal material, hereinafter also indicated as activator, which confers a predetermined colour to the light emitted by the luminescent gelatinous substance 5; for example, a small percentage of silver or manganese or copper can respectively confer, a light blue, orange-yellow-white, greenish colour to the light emitted by the electro-luminescent wire. According to an aspect of the present invention, the luminescent material is mixed with the electrical insulating paint, preferably enamel, and the percentages of luminescent material and of electrical insulating paint in the luminescent gelatinous substance are respectively, about 25% and 75%.

The conductors of the electro-luminescent wire power-supplied using alternating current AC operate like a flat capacitor, generating an electric field which excites the luminescent gelatinous substance 5, and in particular the luminescent material dispersed in the electrical insulating paint, which emits photons and thus light. In particular, the luminescent gelatinous substance according to the present invention can be excited at low intensity of the electric field; advantageously it is sufficient to supply the conductors with an alternating current of low intensity, thus allowing lighting electro-luminescent wires various meters long, over a long period of time, with minimum energy consumptions.

The mixing of the insoluble luminescent material in the electrical insulating paint is carried out through a ultrasonic dispersion system. Such system generates a plurality of air locks through cavitation which confer considerable stability to the suspension, substantially preventing the sedimentation or a non-homogeneous distribution of the luminescent material in the gelatinous substance 5.

Preferably, during the processing, the conductors, already separated from each other by the insulating layer, and substantially covered by a layer of luminescent gelatinous substance 5, are wound by the transparent plastic and laminated film 6, applied at a temperature of about 100° C. Substantially, two portions of the transparent plastic film are superimposed and glued thermally, enclosing the conductors and the gelatinous substance.

Advantageously, the electro-luminescent wire of the present invention has a considerable light greater than the known electro-luminescent wires given that it is not made through a drying procedure—with a UV or thermal treatment, which would modify the molecular structure of the dielectric and the luminescent powder in the transition from the liquid state to the solid state, thus causing micro-cracks during crystallisation, which would reduce the homogeneity of the material solidified around the conductors—but it is made through chemical dispersion of the dielectric, i.e. of the electrical insulating paint, and of the luminescent material, with ensuing formation of the luminescent gelatinous substance around the conductors, with subsequent application of the luminescent gelatinous substance on the conductors and of the transparent plastic film as an outer casing of the wire.

The advantages of the present invention are also clear in the implementation step, and i.e. in the method of production of the electro-luminescent wire, which is entirely simplified and quickened, with ensuing reduction of the cost of production. Actually, the luminescent gelatinous substance has a high adhesion to the conductors and it is poured onto the conductors, preferably tensioned, forming a layer having a predetermined thickness therearound. A spacer system, preferably comb or rake-like, upstream of the supply head, which receives at the inlet a plurality of conductor wires, preferably spaced, for example at 0.70-0.80 mm one from the other, and nears the wires at the output at a predetermined distance, for example at 0.020-0.025 mm, is provided for in order to correctly space the conductor wires in the electro-luminescent wire. Also provided for is a system for adjusting the layer of solid luminescent substance over the conductor wires, downstream of the supply head, which allows levelling the layer by a predetermined degree. Such system can for example be provided through a flat gauge.

The transparent plastic film, preferably provided in reels, is unwound, on a conveyor belt, and conductors are positioned thereon, for example the aforementioned parallel conductor wires having a length substantially equivalent to the length of the film, previously insulated by an insulating layer, which can be provided as a coating of at least one of the two conductors, and previously covered by the luminescent gelatinous substance. In this case, it is clear that the gelatinous substance covers the coating enamelled around at least one of the two conductive wires and it is not directly at contact with the conductive part of such wire.

Figure 8:
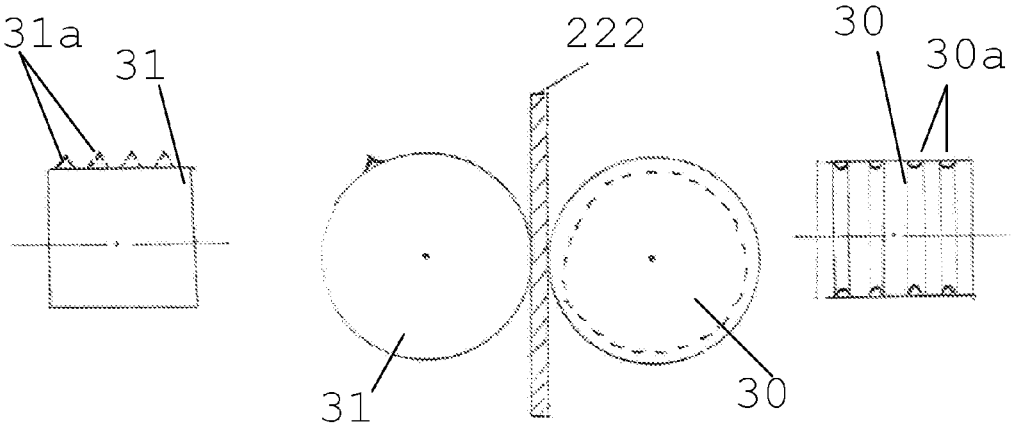
FIG. 8 schematically represents a detail of the machine of FIG. 6.
Figure 8A:
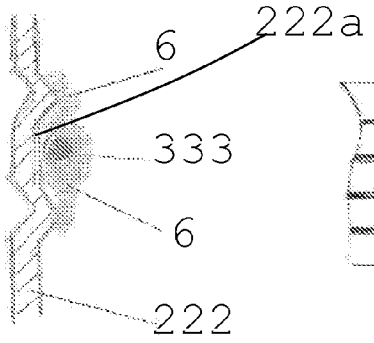
FIG. 8*a* schematically represents another detail of the machine of FIG. 6.
Figure 8B:
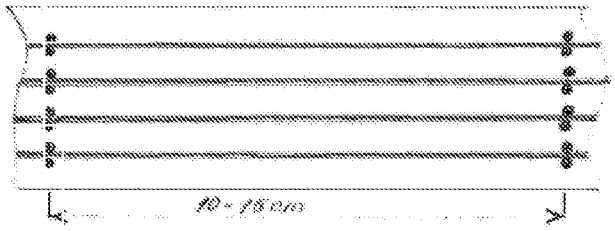
FIG. 8*b* schematically represents a detail of the machine of FIG. 6.

With particular reference to the embodiment of FIG. 4, the method of production also provides for using a pair of rollers between which the flat layer 222 is passed; FIG. 8 schematically represents a first roller 31, provided with projections 31*a*, and a second roller 30, provided with recesses 30*a*, which serve as a guide for the wires 333, during the process of producing the wire (the rollers are represented both in front view and lateral view). The flexible flat layer 222, passing between the two rollers, is elastically deformed in a plurality of housing seats 222*a* of the wires 333, as represented in FIG. 8*a*, which are precisely equally-spaced in this case.

Advantageously, the electro-luminescent wire according to the present invention is capable of emitting much more light than the known wires, with lower energy consumption, having low degree of deterioration; furthermore the method of production is extremely simple and quick to construct, and thus it has very low production costs, thus achieving considerable technical and financial advantages.

The invention claimed is:

1. An electro-luminescent wire comprising:

at least two conductors, having substantially longitudinal extensions, substantially parallel to each other and insulated electrically, the at least two conductors being supplied electrically to generate an electromagnetic field therebetween;

a luminescent gelatinous substance that covers at least one of the at least two conductors; and a transparent plastic film that encloses the luminescent gelatinous substance and the at least two conductors, the luminescent gelatinous substance emitting light in presence of the electromagnetic field.

2. The electro-luminescent wire according to claim 1, wherein the at least two conductors include at least two conductive wires provided with an insulating coating and substantially submerged in the gelatinous substance.

3. The electro-luminescent wire according to claim 2, wherein the at least two conductive wires are alternatingly provided with an insulating coating and alternatingly connectable to one of two reversed electric polarities.

4. The electro-luminescent wire according to claim 1, wherein the at least two conductors include a substantially flat metal layer and one or more conductive wires positioned substantially parallel along the substantially flat metal layer, with interposition of an insulator, the electric field being generated by applying reverse polarities, respectively, to the substantially flat metal layer and to the one or more conductive wires.

5. The electro-luminescent wire according to claim 4, wherein the insulator is a flat layer, positioned between the one or more conductive wires and the substantially flat metal layer, which insulates the luminescent gelatinous substance at contact with the one or more conductive wires from the substantially flat metal layer.

6. The electro-luminescent wire according to claim 1, wherein the at least two conductors include at least one first and one second substantially flat metal layers, and a substantially flat insulating layer between the at least one first and one second substantially flat metal layers, wherein at least one of the at least one first or one second substantially flat layers being perforated and delimiting seats for receiving the luminescent gelatinous substance.

7. The electro-luminescent wire according to claim 1, further comprising a protective plastic material, extruded or molded on the transparent plastic film.

8. The electro-luminescent wire according to claim 4, wherein the substantially flat metal layer is flexible, and enclosed on itself coupling opposite large sides thereof, and forming an electro-luminescent tube with an outer surface that is coated by the luminescent gelatinous substance, for emitting light radially with respect to the electro-luminescent tube.

9. The electro-luminescent wire according to claim 1, wherein the luminescent gelatinous substance includes luminescent material, and an electrical insulating paint, the luminescent gelatinous substance comprising 25% luminescent material and 75% electrical insulating paint.

10. The electro-luminescent wire according to claim 9, wherein the luminescent gelatinous substance includes an enamel that is transparent.

11. The electro-luminescent wire according to claim 2, wherein the at least two conductive wires are made of silver or copper, having thickness of 0.180 mm to 0.200 mm and spaced therebetween by 0.020 mm to 0.030 mm, wherein the insulating coating of the at least two conductive wires is made of enamel, wherein the luminescent gelatinous substance forms a layer around the at least two conductive wires having a thickness of 0.020 mm to 0.025 mm, and wherein the transparent plastic film has a thickness of 0.075 mm.

12. A method for producing an electro-luminescent wire, comprising:

arranging substantially parallel and at a predetermined distance, at least two conductors having a substantially longitudinal extension;

electrically insulating the at least two conductors;

actuating a supply head of a luminescent gelatinous substance and sliding the at least two conductors beneath the supply head, allowing a layer of luminescent gelatinous substance to stick to the at least two conductors; and covering the at least two conductors and the luminescent gelatinous substance with a transparent plastic film.

13. The method according to claim 12, further comprising covering the transparent plastic film with a transparent plastic protective layer.

14. The method according to claim 12, wherein the luminescent gelatinous substance is provided through chemical dispersion of a luminescent material in a transparent insulating paint, through an ultrasonic reactor.

* * * * *